US008123504B2

(12) United States Patent
Lenhart

(10) Patent No.: US 8,123,504 B2
(45) Date of Patent: Feb. 28, 2012

(54) PISTON PUMP FOR THICK MATERIALS

(75) Inventor: Manfred Lenhart, Haltern am See (DE)

(73) Assignee: Schwing GmbH, Herne (DE)

( * ) Notice: Subject to any disclaimer, the term of this patent is extended or adjusted under 35 U.S.C. 154(b) by 1267 days.

(21) Appl. No.: 10/590,795

(22) PCT Filed: Feb. 25, 2005

(86) PCT No.: PCT/EP2005/002018

§ 371 (c)(1),
(2), (4) Date: Jun. 11, 2007

(87) PCT Pub. No.: WO2005/083267

PCT Pub. Date: Sep. 9, 2005

(65) Prior Publication Data

US 2008/0038131 A1 Feb. 14, 2008

(30) Foreign Application Priority Data

Feb. 26, 2004 (DE) ..... 10 2004 009 363

(51) Int. Cl.
*F04B 7/00* (2006.01)
*F16K 11/074* (2006.01)

(52) U.S. Cl. ..... 417/519; 417/53; 417/539; 417/900; 137/625.24

(58) Field of Classification Search ..... 417/519, 417/539, 900; 137/625.24, 625.21, 625.22
See application file for complete search history.

(56) References Cited

U.S. PATENT DOCUMENTS 2,369,566 A * 2/1945 Hall ..... 123/190.17
3,266,435 A * 8/1966 Smith ..... 417/515
4,345,883 A * 8/1982 Westerlund et al. ..... 417/317
4,730,545 A * 3/1988 Eickmann ..... 91/480
5,380,174 A 1/1995 Schwing ..... 418/519
5,957,675 A * 9/1999 Buehrer et al. ..... 417/519
6,113,368 A * 9/2000 Hofmann ..... 417/539
6,244,838 B1 * 6/2001 Couillard et al. ..... 417/426

FOREIGN PATENT DOCUMENTS

GB 1063020 3/1967

OTHER PUBLICATIONS

International Search Report for corresponding PCT application No. PCT/EP2005/002018 dated Jun. 20, 2005.

* cited by examiner

*Primary Examiner* — Devon C Kramer
*Assistant Examiner* — Philip Stimpert
(74) *Attorney, Agent, or Firm* — Gardner, Linn, Burkhart & Flory, LLP

(57) ABSTRACT

In a multi cylinder thick materials pump for feeding concrete in particular, whose at least two feeding cylinders feed the thick material from a pre filling container into a feed line, and a shift valve for alternatively connecting the feeding cylinders, having a feed line associated with it, comprising at least two rotationally movable valve bodies, each comprising a straight transfer section between each one of the feeding cylinders and the feed line, connected downstream of the feeding cylinders to a collector tube, the shift valve including at least one, but preferably two rotationally movable rotating slides each of them comprising a straight transfer section for connecting the feeding cylinder respectively associated with it to the feed line, and at least one section blocking the connection. Also a process for operating of this thick materials pump for continuous feeding is described.

37 Claims, 4 Drawing Sheets

PISTON PUMP FOR THICK MATERIALS

Figure 1:
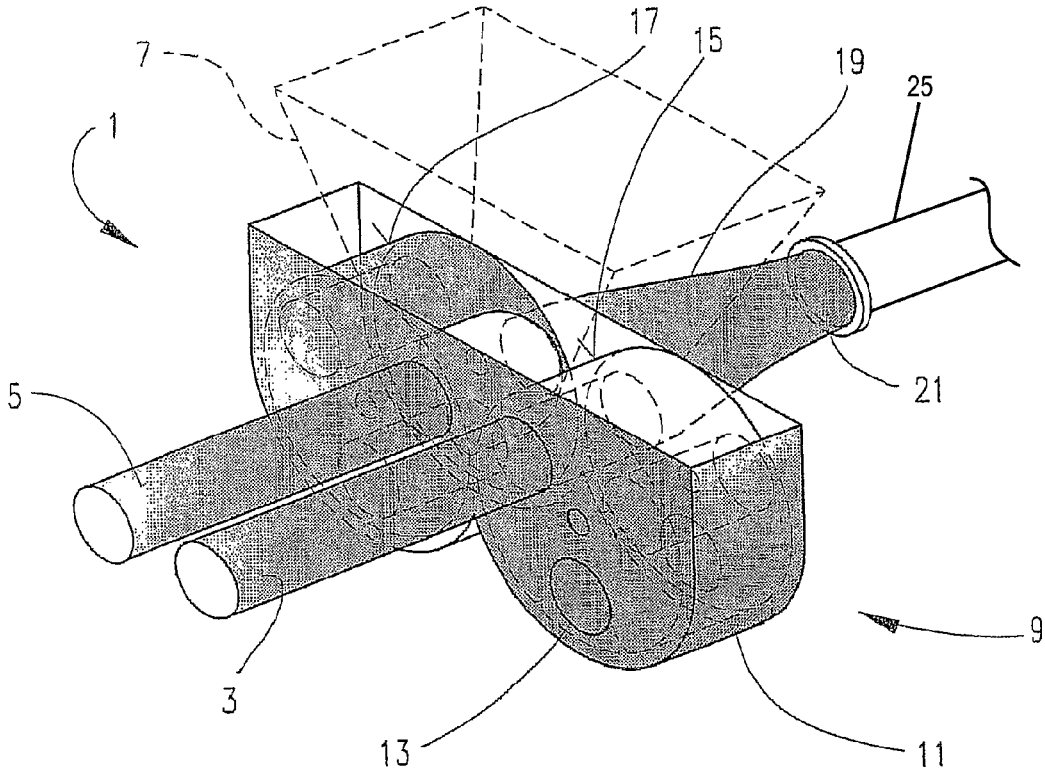

The present invention regards a pump for thick materials with features according to the non characterizing part of patent claim 1. In a broader sense it also regards the controls of such thick materials pumps.

Thick materials piston pumps have been used for a long time in particular at construction sites to feed concrete. Usually they are provided as hydraulically operated piston pumps, mostly with two cylinders, feeding concrete through hoses or pipes. Subsequently, in a simplified manner, concrete feeding is being referred to. The invention is not limited to an application with concrete feeding pumps but can be used for all similar thick materials pumps.

Such pumps have to fill a single feed line with two alternatively filled cylinders and associated pistons. The respectively filled cylinder is being connected with the feed line via a moveable pipe switch. Subsequently the piston pushes out the concrete (pump stroke), while the parallel piston is being retracted, in order to fill the cylinder with concrete again (suction stroke). At the end of each stroke the moving direction of the cylinder pistons is reversed and the pipe switch is adjusted, so that pump strokes and suction strokes alternate continuously. The two pump pistons are preferably driven hydraulically, coupled amongst each other, so that they basically work in a counteracting manner.

Common pipe switches (DE 29 33 128 C2) are arranged, so that they can be switched back and forth between two end positions, wherein they alternatively establish the connection between the cylinder openings and the feed line on the one hand, and the pre filling container on the other hand. From this results discontinuous feeding.

U.S. Pat. No. 3,663,129 describes a concrete pump with continuous feeding, wherein the shift valve or its pipe switch consists of a so called sleeve slide. Its waist opening is continuously but pivotally connected with the mouth of the feed pipe as a downstream outlet. Its kidney shaped inseam opening (inlet, upstream) is long enough to cover the openings of both pump cylinders simultaneously. During the operation the pipe switch performs a continuously oscillating pivoting motion, whose axis is coaxial with the mouth of the feed pipe. The pivoting angle of the pipe switch is approximately 50° to both sides from the middle.

The pistons of the pump cylinders are controlled depending on the momentary position of the pipe switch, so that in the moment when both cylinder openings are covered by the sleeve opening, one cylinder is at the end, and the other cylinder is at the beginning of a pump stroke. Thereby the feeding action continuously shifts from one cylinder to the other. In the state of the art control system for the suction stroke and for the pump stroke of each cylinder the same time span is used. Therefore there is no simultaneous feeding of both cylinders.

Due to the only one sided bearing of the state of the art pipe switch on the side of the feeding pipe, and due to the enveloping support and sealing surfaces only surrounding sleeve opening, the substantial tilting moments of the state of the art design can not be completely received. It can not be excluded, that due to gap formation substantial leaking losses occur in the seal area between the sleeve opening of the pipe switch and the feeding cylinders, which in turn denies the realization of a really continuous feeding action.

The British Patent 1,063,020, as a gender defining state of the art describes a multi cylinder thick materials and concrete pump, whose shift valve in one embodiment comprises two rotating valves, (also formed as sleeve valves), each controlled by a lifting cylinder of their own. Their outlet ports are connected with a common Y-tube, which in turn is connected to the feed line downstream. Each rotating slide can either work together with a single, or with two pump cylinders. Though synchronous control of the rotating slides is mentioned, however with this state of the art pump and control system continuous feed of the feeding cylinder into the common feed line is neither intended nor possible.

Furthermore it is also state of the art, to provide thick materials pumps of the kind that is being discussed here, with an insertion station, through which a cleaning body for removing unused thick materials, which have remained in the feeding line, can be inserted. This insertion station comprises e.g. a chamber slide, moveable by a motor or hydraulically, with at least two chambers of equal cross section. In the resting position of the insertion station the one chamber forms a section of the feed line, while the other chamber is freely accessible. Into the latter the said cleaning body can be manually inserted from the outside. For a cleaning procedure, with the thick materials pump shut down, the insertion station is shifted into a working position, wherein the chamber containing the cleaning body replaces the other chamber within the feeding line. Thus the cleaning body can be pressed through the feed line with compressed air, whereby it pushes the thick material ahead of itself. These state of the art insertion stations, however have to be provided in addition to the shifting valve discussed above.

The objective of the invention is to provide an improved thick materials pump and a process for controlling a thick materials pump with a continuous material flow.

This objective is accomplished according to the invention with the features of patent claim one, with respect to the control process with the features of the independent claim 23.

The features of the dependent claims associated with the independent claims provide advantageous improvements of the invention.

While with the pumps according to the above explained U.S. and GB patents the rotating sleeve slides are mostly located at the thick materials container in an exposed manner, and having to be driven with a certain eccentricity around their rotational axis through the thick material in the prefilling container, through providing the shift valve with two substantially smooth walled cylindrical (preferably drum shaped) rotating slides an embodiment, less exposed to the resistance of the thick material especially to the concrete, can be created for the preferred application. On the one hand this is valid for abrasive uses, but also for loading through dynamic pressure in the feeding line or in the feeding cylinders.

In the area of the rotating slides the thick material is, different from the known sleeve slides, not redirected under pressure, but substantially only run through the tubing sections in a straight manner. Only in the collector tube (also Y-tube) the concrete flows from the feeding cylinders are merged. This substantially contributes to the pressure relief of the slides themselves and does not only reduce the loads on the bearings, but also reduces the frictional forces when shifting the rotating slides. Consequently this engineering solution noticeably reduces mechanical wear of the moving and non moving parts of the shift valve.

It should be noted, that though a two cylinder thick materials pump is discussed here in an a preferred embodiment, the design according to the invention can also be transposed to pumps with three or more cylinders, wherein a rotating slide would have to be associated with each feeding cylinder.

For providing the shift valve (guidance structure and rotating slide) with sliding guides with friction and abrasion resistant materials and possibly with wear parts known means can be applied, so this does not need to be discussed in detail. The same applies for the seals between the rotating slides and the openings of the feeding cylinders and the collector tube.

According to the invention it is advantageous, when the rotating slides can occupy three different positions, a transfer position, a blocking position and an inlet position. To these three positions corresponds a design or a subdivision of the rotating slides with three different sections, this means a transfer section, a blocking section and an inlet section. The names of the sections or positions are self explanatory and will be discussed in connection with the description of the attached figures.

Different from the triple division mentioned above, also other variants are possible. For example between the transfer position and the inlet position a blocking position can be provided on both sides, which, through respective sections provides a quadruple division of the rotating slides over their circumference.

In another variant the above mentioned triple division can be doubled by providing two inlet positions and two transfer positions and two blocking positions, or the respective sections per rotating slide. In the latter variant there is for example the following sequence: inlet section—blocking section—transfer section—inlet section—blocking section—transfer section.

In all variants the sections are preferably located in an evenly distributed manner over the circumference of the rotating slides, wherby in case of triple division, angles of 120°, in case of quadruple division angles of 90°, and in case of sextuple division angles of 60° are created. In particular for the last two variants a continuous revolving operation of the rotating slides is possible.

It is advantageously possible to provide/prefabricate the above mentioned sections as single modules and to assemble them in the required order. Overall a control box or a control cage with the necessary valve travel or functions is created. This design can favor the simple replacement of single, prematurely worn or damaged sections, in particular when connections are provided amongst them, which can be disassembled.

It is understood that the two rotating slides are advantageously identical amongst each other or mirror images of each other; variations can result from space constraints, when attaching the respective drive systems.

A very substantial advantage of the solution according to the invention is the simply applicable option to use at least one, possibly both rotating slides of the shift valve also as insertion station(s) for the cleaning bodies. The short tubing sections of the rotating slides and the feed line have to be cleaned during operation shut down of the pump, this means residual thick material or concrete leftovers have to be removed.

For this purpose the invention provides access to the rotating slides in an advantageous refinement. This can be provided e.g. through flaps, which are normally closed, but provide access after opening.

For this a separate cleaning—or insertion position of the rotating slide(s) can be provided. According to an advantageous refinement, however the inlet position of the rotating slide is used as an insertion position for the cleaning bodies at the same time. This is possible, because in this inlet position the tubing cross section of the rotating slides is without function and also without pressure.

Based on the state of the art initially discussed such a combination is neither provided, nor easily possible.

The rotating slides can be operated in an oscillating or in a rotating (revolving) manner. As drives for the rotating slides preferably hydraulic actuators are being used, tilting or rotating the rotating slides around their rotating axes through rods and/or cranks. A possible embodiment is discussed in the gender defining state of the art GB-PS 1 063 020. Also other suitable rotating position drives, e.g. electric motors, linear gear drives etc. can be used. With the prerequisite that the flow paths of the rotating slides are not disturbed, also a slinging or belt drive is conceivable. Hereby the rotating slides are surrounded on a (possibly stepped) part of their circumference by a band (Flat-, V-, Cog-, Multi V-Belt), which on the other hand is run over a drive shaft. For such slinging drives certainly each rotating valve can be provided with a pulley of it own on its axial shaft.

Further details and advantages of the invention become evident from the drawing of an embodiment and it's following detailed description.

Figure 2:
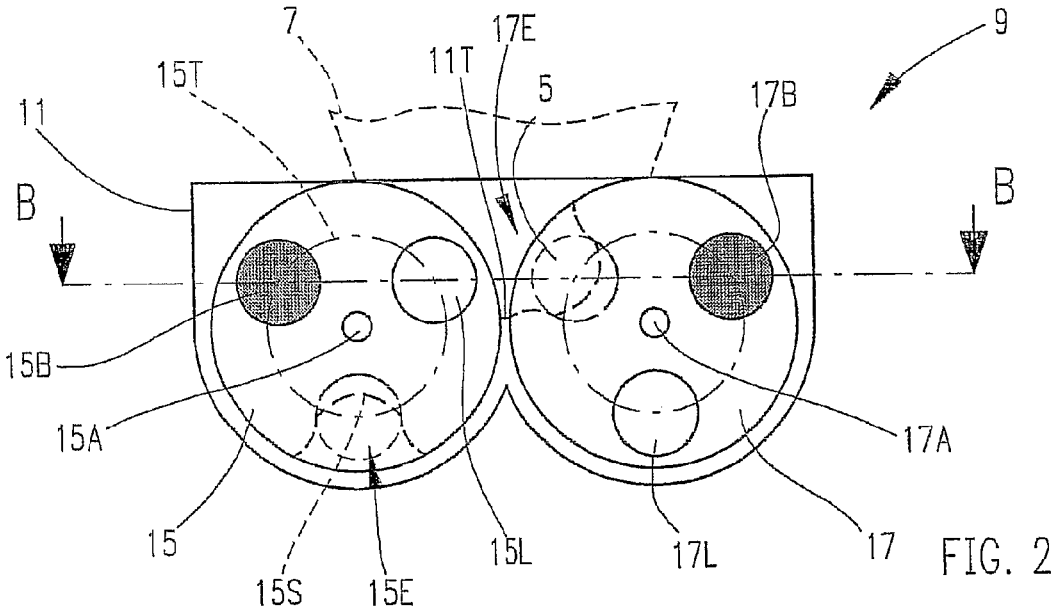
Figure 3:
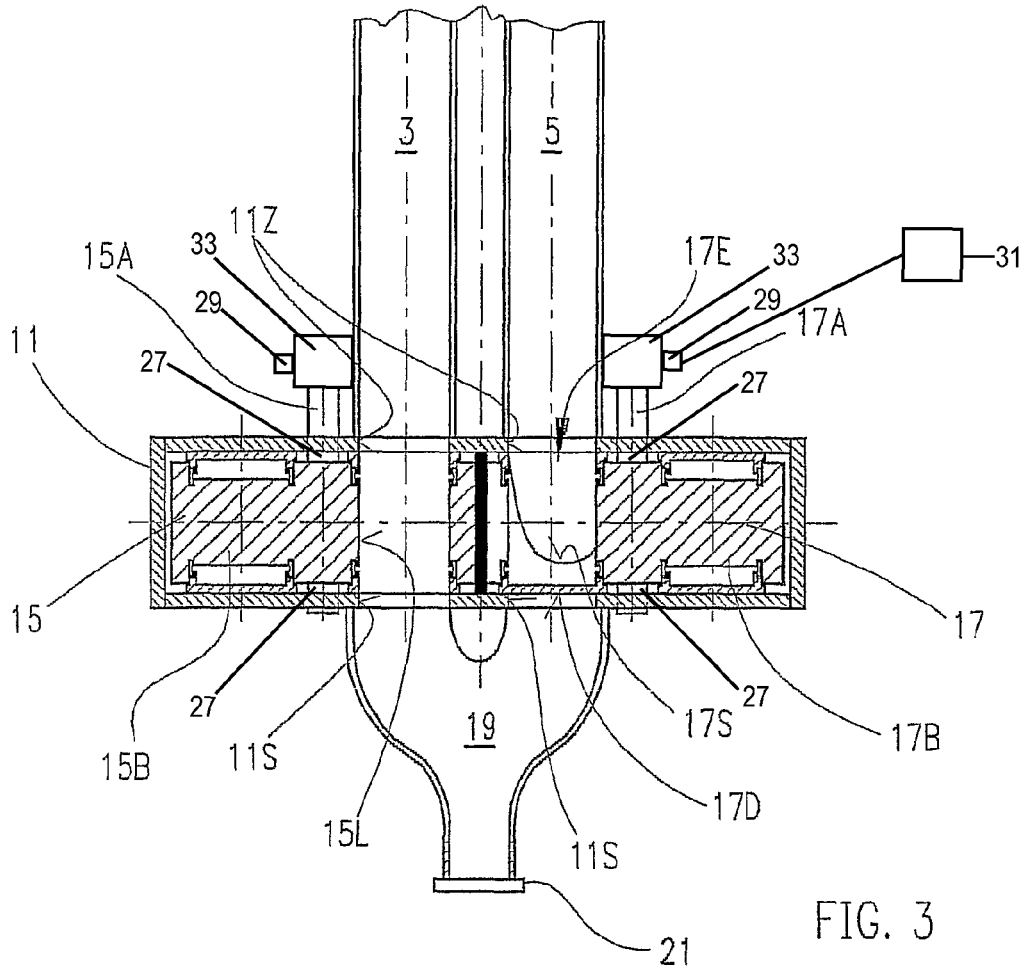
Figure 4:
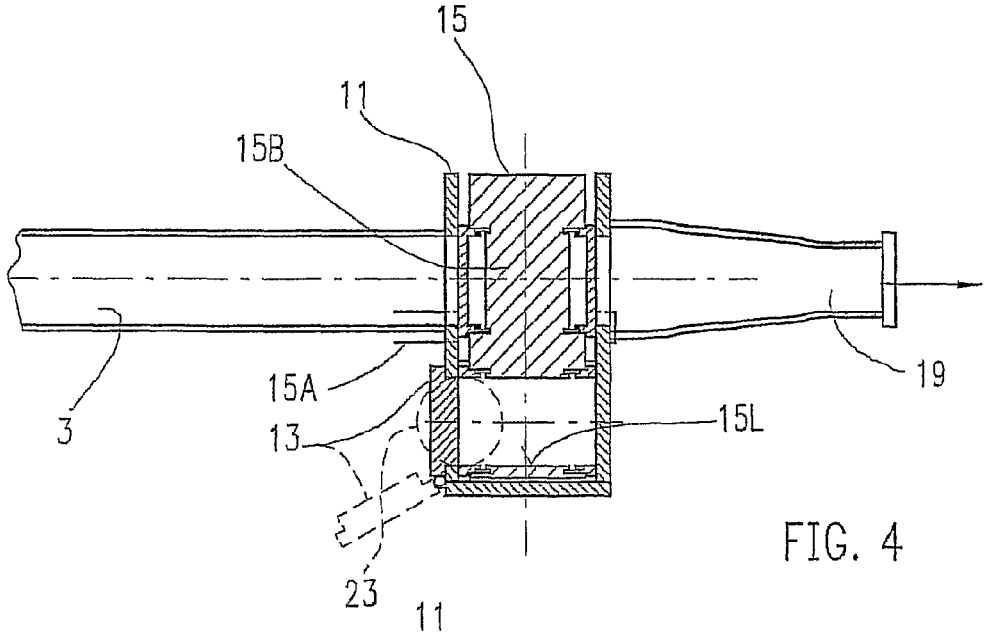
Figure 5:
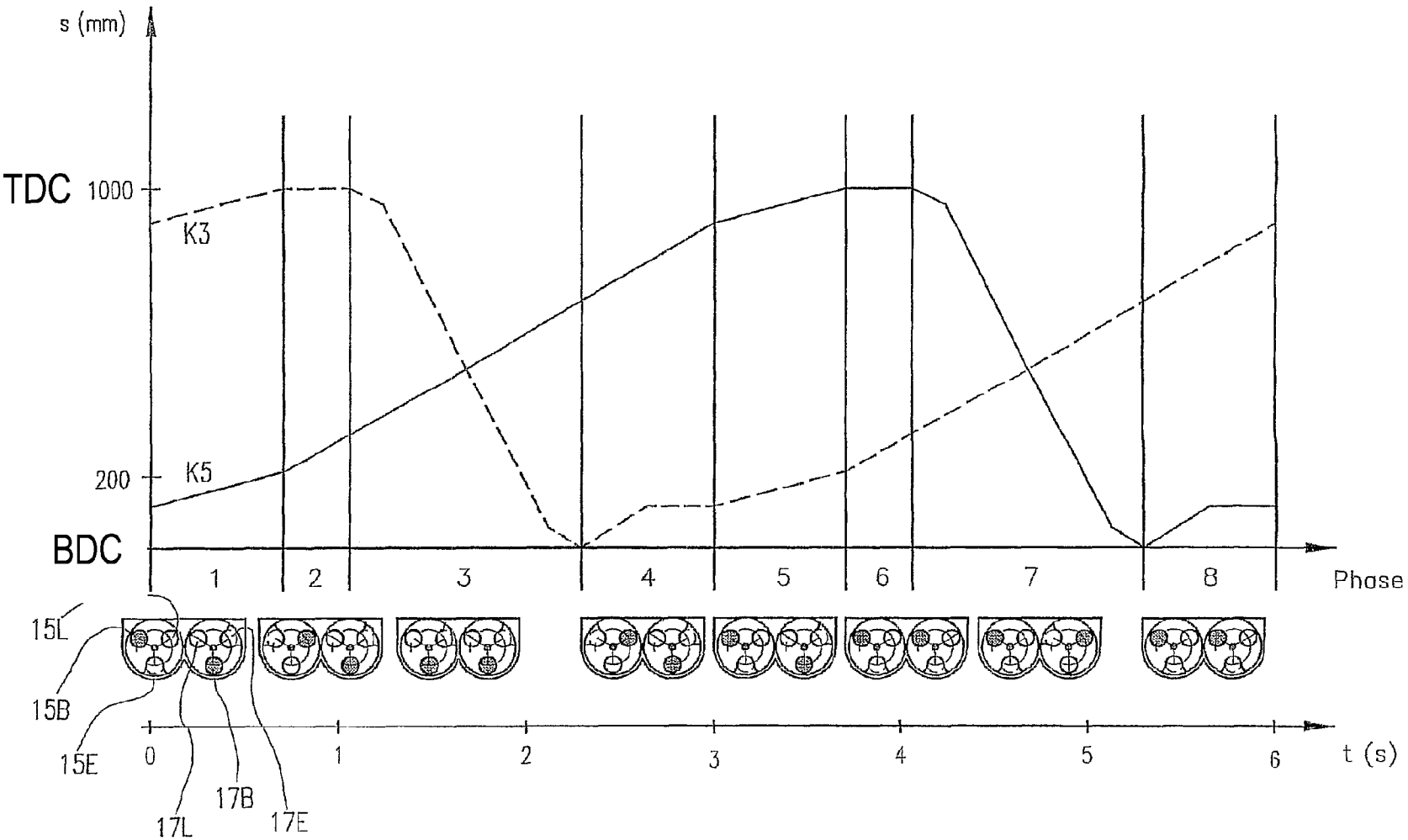
Figure 6:
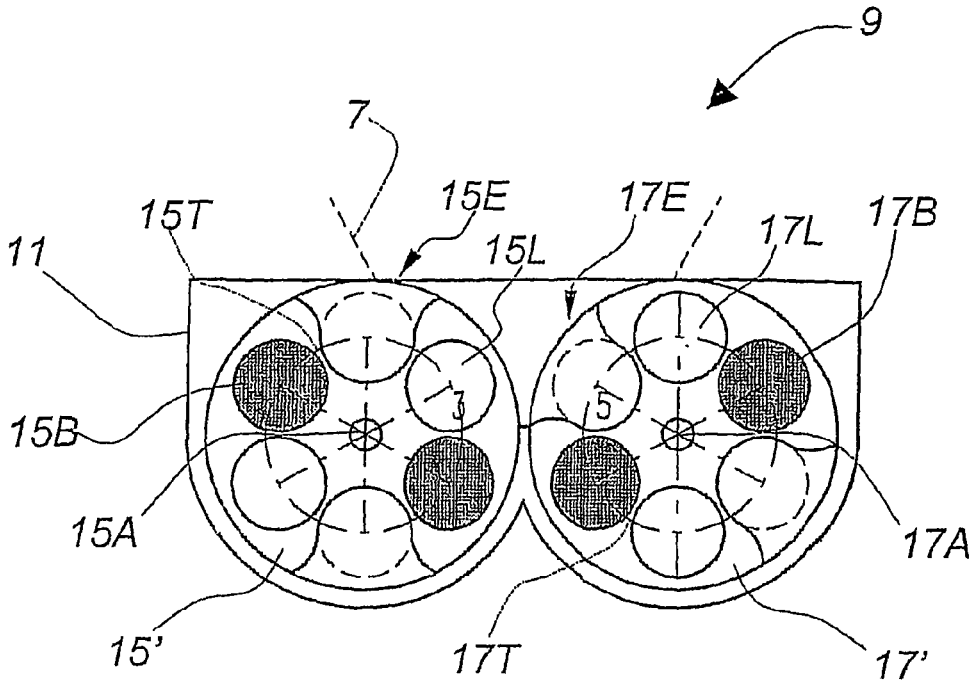
Figure 7:
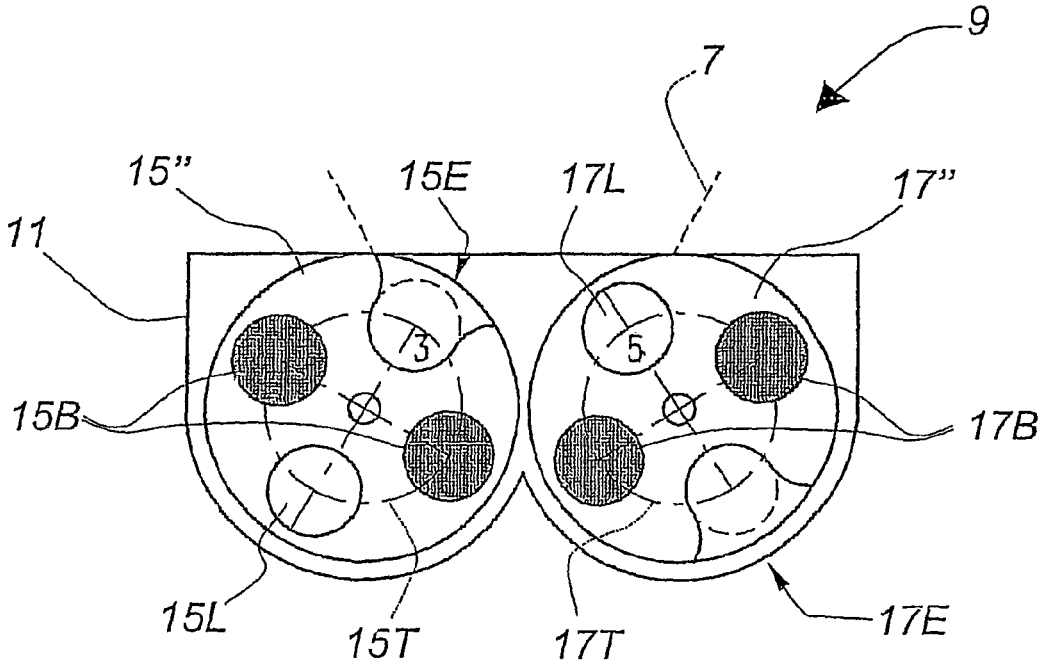

In a highly simplified and purely schematic illustration the Figures show:

FIG. 1 a perspective view of the thick materials pump assembly with accessories;

FIG. 2 a frontal view of a partial cut view of a double rotating slide shift valve according to the invention;

FIG. 3 a cut view along the middle axis of the feeding cylinders of the thick materials pump according to FIG. 2 (line B-B) for emphasizing the location of the feeding cylinders, the shift valve and the collector tube;

FIG. 4 a cut side view of the shift valve in a position suitable for inserting the cleaning body;

FIG. 5 a time-distance-diagram of the phase shifted strokes of both pistons of the thick materials pump relative to the respective positions of the two rotating slides;

FIG. 6 a first embodiment of the rotating slides of the shift valve;

FIG. 7 a second embodiment of the rotating slides.

FIG. 1 shows the perspective outlines of a thick materials pump 1 with two parallel feeding cylinders 3 and 5, lying next to each other, a funnel shaped prefilling container 7, open on top, a shift valve overall designated as 9. The latter is located in a housing, or in a guidance structure 11, on the bottom of the prefilling container 7. Close to the bottom of the tub shaped guidance structure 11, on the side facing the feeding cylinders 3 and 5, a normally always closed maintenance flap 13 can be provided, whose function will be discussed later.

The pistons belonging to the feeding cylinders 3 and 5 are not shown. Both pistons are driven independently of each other (preferably hydraulically) and can in principle assume any relative position and velocity within the confines of their strokes and drive systems. However it is also possible to operate them in a hydraulically coupled manner. Both cylinders and pistons have the same diameter, e.g. 250 mm.

The guidance structure houses two drum shaped rotating slides 15 and 17 forming the valve bodies of the shift valve 9. The rotating slide 15 is associated with the feeding cylinder 3, the rotating slide 17 is associated with the feeding cylinder 5. Only via the shift valve 9, or the valve paths of the rotating slides thick material reaches the feeding cylinders 3 and 5, and only via this shift valve the feeding cylinders eject the thick material into the feed line, not shown here, as will be described in detail later. Eventually downstream of the shift valve 9 a collector- or Y-tube 19 with a flange 21 is provided for connecting the feed line 25. The collector tube 19 and the beginning of the feed line 25 are advantageously positioned at the same elevation as the axis of the feeding cylinders 3 and 5.

The guidance structure is bolted onto the open ends of both (lying) feeding cylinders 3 and 5. Into its interior, from the top, out of the prefilling container 7, gets the thick material to be fed by the thick materials pump, preferably only into the space of the "corner" between the two rotating slides 15 and 17. This corner forms a downward extension of the funnel of the prefilling container, and the thick material only gets into a location, where it is eventually also sucked into the cylinders. It is provided in the design, that both rotating slides have one inlet channel each, which can be fed from this corner (FIG. 2, 3).

The openings of both feeding cylinders 3 and 5 exit within the respective wall surfaces of the guidance structure 11, covered by the drum shaped rotating slides 15 or 17, in the lower area on two sides of the above mentioned corner. Thereby, during sucking of thick material into the feeding cylinders always a maximum filling level of thick material remains above the cylinder openings.

Though the guidance structure 11 could be provided as an open frame, in particular shaped like a shelf. However, preferably it is constructed as a substantially closed box with several functional openings. In particular in its upper area it is kept open far enough to provide an undisturbed inflow of the thick material to the shift valve, also directly at the bottom of the prefilling container. Besides an upper opening also an open side towards the feeding cylinders will be necessary.

FIG. 2 illustrates the engineering design of the shift valve 9 and its rotating slides 15 and 17. The feeding cylinders 3 and 5 are located longitudinally and covered in viewing direction behind the guidance structure 11. The lower part of the prefilling container is shown again in dashed lines. One can see, that it leads into the above mentioned upper, corner formed by the enveloping surfaces of the rotating slides. At the bottom of corner a separating wall 11T of the guidance structure 11 becomes visible, ending between the two rotating slides at a spot, where these are closest to each other. It would also be conceivable to make the separating wall between the rotating slides 15 and 17 higher, e.g. up to upper rim of the guidance structure 11, in order to divide the thick materials flows destined for the two feeding cylinders.

Both rotating slides 15 and 17 can be positioned within the guidance structure 11 around rotating axes 15A or 17A in three different predefined shifting positions. They have bearings 27 on both sides (on the side of the feeding cylinders and on the side of the collector tube) in order to assure the movability of the rotating slides also under high external loads. This is accomplished through the drive system, which will be explained later, either in oscillating (tilt-) operation, or in rotating (revolving) operation. They have to provide the connection between the prefilling container and the feeding cylinders 3 and 5 on the one hand, and the feeding cylinders and the collector tube 19 with the connected feed line on the other hand. Therefore they comprise three functional sections, which follow each other on partial circles 15T/17T, displaced by 120° around the rotating axes, and which are identical on both rotating slides. Therefore they are subsequently described together.

An inlet section 15E/17E is intended to run thick material from the prefilling container 7 into the respective associated feeding cylinder 3. Consequently it is open on top (in radial direction) towards the prefilling container and sideways (parallel to the rotating axis) towards the feeding cylinder. In its functional position (inlet position) it lies exactly between the openings of the respective feeding cylinder and the collector tube. Therefore its surfaces facing away from the feeding cylinders and to the collector tube 19 are closed through sealing surfaces. Therefore in the inlet position of the rotating slide there is no connection with the collector tube, or it also remains closed towards the prefilling container 7. As will become clearer later, this enables a feeding operation of the respective other feeding cylinder during the refilling of the one feeding cylinder with the idea of continuous operation.

For rerouting the thick material by 90° from the radial exit from the prefilling container into the axial exit towards the respective feeding cylinder the inlet sections are preferably provided with a slide, this means with a spherically curved gutter section; in this position also a respectively angulated elbow tube, possibly with a radial intake, expanded like a funnel could be used and integrated into the structure of the rotating slide. The free cross section of the intake section preferably approximately corresponds to the cross section of the feeding cylinder preferably forming a (deflection) angle of 90°.

Offset by 120° clockwise along the partial circle 15T/17T follows upon the inlet section 15E a locking—or blocking section 15B/17B. It only serves the purpose to block the connection between the respective feeding cylinder and the collector tube 19 on both sides, thus it is without any flow guiding function.

Offset by another 120° along the partial circle 15T/17T follows a transfer section 15L/17L, preferably comprising a short tube section, open on both sides, and straight in particular with the same inside cross section (250 mm diameter) as the feeding cylinders. In FIG. 2 and FIG. 3 (left) the layout of the shape and size of the transfer section 15L can be seen clearly.

As mentioned above, the mentioned sections can be considered single modules which can be prefabricated and assembled into a rotation slide. Overall the rotating slides 15 and 17, with their part of the guidance structure 11 respectively form a 3/3way valve together with the inlet slides, the openings of the feeding cylinders and the openings of the collector tube as paths and together with the three positions described above.

In the position shown in FIG. 2 of the shift valve 9 the intake section 17E of the rotating slide 17 is in its active position, open towards the corner space (the feeding cylinder 5 is refilled with new thick material), while the transfer section 15L of the rotating slide 15 simultaneously forms the connection between the feeding cylinder 3 and the collector tube 19, so that the feeding cylinder 3 can eject thick material. In FIG. 5, which still needs to be discussed this corresponds to phase 7 of the motion phases of the shift valve. The exactly reversed functional position of the shift valve is shown in phase 3 of FIG. 5.

When a blocking section 15B/17B is located in front of the opening of the respective feeding cylinder, then the feeding cylinder on the one hand, and the collector tube on the other hand are closed through it. After filling with thick material the respective feeding cylinder thus can perform a short pre compression stroke, in order to adapt the pressure in the freshly filled in thick material to the pressure in the feed line following the collector tube. At the same time, through the sealing surface towards the collector tube 19 an influence upon the pressure in the feed line is avoided.

In the cut view of FIG. 3 on the right side the geometric layout of the intake section (here 17E) next to the gutter (17S) of the rotating slide (here 17) on the feeding cylinder 5, as well as the position of the sealing surface 17D in front of the opening of the collector tube 19 can be seen well. Here the thick material can flow (axially)from the prefilling container 7 only via the slide 17S into the opening of the feeding cylinder 5; the same holds for the respective inlet position of the rotating slide 15.

On the left in FIG. 3 the congruence of the cross sections of the feeding cylinder 3 and the transfer section 15L of the rotating slide 15 can be clearly seen. The guidance structure 11 itself has cylinder side openings 11Z and opening 11S towards the collector tube 19, respectively having the same cross section respectively as the feeding cylinders or the transfer sections.

The basic drum shape of the rotating slides 15 and 17 can here can also been seen well. These can e.g. be made as round boxes from flat material, wherein insert pieces like transfer—and gutter sections etc. have to be attached. In particular one recognizes here the arrangement of cutting rings, known from conventional sleeve slides on both sides of the transfer section 15L and at the cylinder side opening of the inlet section 17E. Furthermore the two blocking sections 15B and 17B are closed on both sides with sealing plates, which are pressed to the interior walls of the guidance structure like the cutting rings through elastic rings or similar and glide on the rotating slides when they pivot. Thereby they support a safe function of the shift valve 9. The cutting rings surround, in the inlet or transfer position of the respective rotation slide, the openings 11Z or 11S of the guidance structure, the sealing plates close them in the blocking position. The interior walls of the guidance structure 11 will have to be supplied with respective wear plates, as they are widely known in the state of the art.

It is conceivable, on the surface of the rotating slides 15 and 17, facing the collector tube 19, to provide a respective common seal plate for the blocking—and inlet section, which can extend along the partial circle with approximate kidney shape by an angle of approximately 150°.

It is not absolutely mandatory to provide the walls of the guidance structure 11 as completely closed, since the rotating slides 15 and 17 are safely held on their rotation axes 15A and 17A. However, for safety reasons, (ingestion of foreign objects, avoidance of unintentional reaching in etc. and other accidents risks) it can be advantageous to keep them closed. In particular in lower positions of the (after the last intake process still partially filled with thick material) inlet sections 15E and 17E, it can however not be avoided that thick material gets into the lower tubs of the guidance structure. It can therefore be useful to provide the bottom of the guidance structure (thus the two tub parts, which can be seen well in FIG. 2 and which abut to the separating wall 11T from below) as perforated and/or with dump flaps, so that water seeping in e.g. through the gaps between the rotating slides and the guidance structure can run out. Possibly even a dump hole can be provided, through which the thick material can fall out of the inlet sections by itself, aided through gravity.

In addition it can be useful to provide sealing rims at both radial outer edges of each inlet section on the enveloping surface of the rotating slide, which extend in axial direction of the rotating slide, sliding along the interior walls of the guidance structure, as soon as the intake section reaches a non active position. Thereby it could mostly be avoided, that the thick material in the inlet section is smeared onto the above mentioned walls, eventually blocking the rotation of the rotating slides.

The diameters of the rotating slides are approximately 800 mm in this illustration, thus a little bit more than three times the interior diameter of the feeding cylinders. This dimension can possibly still be reduced, if the partial circles 15T and 17T can be provided with smaller diameters with the same functionality of the valve bodies. The thickness or depth of the rotating slides (dimension seen in longitudinal direction of the feeding cylinders can certainly be adapted to the respective installation conditions depending on the respective requirements. In order to provide a intake cross section as large as possible for the slides, they should however not be smaller than the cross section of the feeding cylinders themselves, and will therefore be at approximately 300 mm. Thereby the depth of the guidance structure—without tube connections and drive components—reaches approximately 350 mm with a height of approximately 850 mm and a width of approximately 1650 mm.

In this cut view the shape and the technical function of the collector tube can be seen even better. In a known manner it is provided as a Y-tube whose both legs are each connected to a rotating slide 15 or 17 and whose "mouth" or intake flange 21 is directly connected to the feed line, which is not shown in detail here. The free cross section of the Y-tube in the flange area is smaller (approximately 180 mm diameter), than in the exit area towards the rotating slides.

Through the selected engineering design with directly neighboring rotational slides overall a very compact set up of the shift valve 9 is accomplished. As can be seen in FIG. 2 the sections 15L and 17E, relevant for the through flow when filling and expelling the feeding cylinders are located at the same elevation as the rotating axis 15A and 17A, when they are in their functional position, this means they deviate, laterally on both sides of the separating wall 11T and above, from their maximum proximity position only by a small amount. Thereby the lateral distances of the feeding cylinders 3 and 5 and the total width of the collector tube 19 remain sufficiently small.

FIG. 4 only shows the feeding cylinder 3 of the thick materials pump 1, which lies in front in this view, from its open (exhaust-) end. The second feeding cylinder 5 is located behind the feeding cylinder 3, covered in viewing direction. One sees here the flap 13, already mentioned above, once in a closed position (solid line) and once in an open (dash dot line) position. The transfer section 15L of the rotating slide 15 in its lowest position is located at the elevation of flap 13. In this context it should be noted, that for each rotating slide 15 and 17 such a flap 13 can be provided, but that due to the close proximity of both rotating slides in the guidance structure, certainly also a common dump flap for both rotating slides 15 and 17 could be provided. It would then certainly have to be wide enough, in order to provide unrestricted access (in particular for inserting cleaning bodies) into both rotating slides (or into their transfer sections).

Since the respective guidance section is completely separated from the feed line in this position, there is no elevated pressure in it. Their will be no pressure load on (this) these flap(s) during normal operation, so that they do not have to be especially strong and also not sealed in a particular manner. Irrespective of that, it will be assured through suitable measures, that the flap 13 can not be opened when the thick materials pump and the shift valve run in feed operation, and that the shift valve can not be shifted, while the flap is open.

After opening the flap(s) 13 thick material remaining in the transfer sections 15L and 17L can easily be removed. During normal operations of the shift valve this is normally not necessary, since this relatively small amount of thick material or—column is expelled with the next feed or expulsion stroke of the respective feeding cylinder towards the collector tube and the feed line.

After opening the flap 13 also a cleaning body 23 (also shown in FIG. 2 in dash dot lines) can be inserted into the transfer section 15L or 17L. After closing the flap 13 it can be moved in the transfer section through switching the rotating slide, between the openings of the respective feeding cylinder or the collector tube 19. Subsequently it is run through the collector tube and the feed lines e.g. through compressed air, which is provided through an infeed between the feeding cylinder and the rotating slide, which is not shown here, in order to purge these lines from remaining thick material.

Through a passage of a cleaning body through both branches of the collector- or Y-tube 19, these two are also purged, whereby the thoroughness of the cleaning of the feed line can be increased through double passage of a cleaning body (subsequently through both branches of the collector tube and then through the common feed line). It is understood, that for both processes the same cleaning body 23 can be used twice, or different cleaning bodies can also be used.

Through a suitable shape of the collector tube 19 in the corner area and/or through simultaneous pressurization into both branches of the collector tube, it can be assured that the cleaning body does not get caught in the collector tube branch, which has been cleared before, upon its second passage.

With reference to FIG. 5, a time-distance diagram of the feed pistons and the motion phases of the rotating slides 15 and 17 of the shift valve 9, after introducing all major parts of the thick materials pump according to the invention and its periphery, the feed process per se and the controls of the thick materials pump and its shift valve are explained and discussed in detail. The two pistons of the feeding cylinders 3 and 5 are only represented as reference numerals K3 & K5 at the beginning of the respective diagram line. The motion or motion cycle of the piston K3 is shown in a dashed line, the one of the piston K5 in a solid line.

The above mentioned motion phases of the shift valve, whose reduced schematic display corresponds to the view of FIG. 2 are numbered from 1 through 8 and shown next to each other in a diagram plotted over time, and separated from each other through vertical lines. The functional sections of the rotating slides are once more designated with the associated reference numerals.

In phase one both rotating slides 15 and 17 are in their "transfer position", this means their transfer sections 15L and 17L are located in front of the openings of the feeding cylinders 3 and 5 at the same time (in the following also starting position). Both feeding cylinders 3 and 5 are also connected to the collector tube 19 and the subsequent feed line. None of the feeding cylinders communicates with the pre filling container 7.

According to phase 1 of the diagram the piston K3 of the feeding cylinder 3 moves towards the end of a pumping stroke, while the piston K5 of the (freshly filled) cylinder 5 just starts with a new pump stroke after a pre compression. Both pistons are moved in parallel and in the same direction at relatively slow speed. This can be called "synchronous motion phase".

Phase 2 is a transition of the feeding cylinder 3 between the pump stroke and the intake stroke. The rotating slide 15 was—preferably after stopping the piston K3—tilted by 120°, while the rotating slide 17 remained stationary. The opening of the feeding cylinder 3 is tightly sealed tight by the blocking section 15B, its piston K3 stops for a short time before changing its stroke direction. The feeding cylinder 3 is completely closed relative to the collector tube 19. This in between—or blocking position of the rotating slide 15 safely avoids any fluidic short cut between the pumping and the intaking feeding cylinder.

During this relatively short phase the control slide 15 can move continuously; or it can be slowed down or stopped temporarily, in case the blocking section 15*b*, as discussed, is provided very short. However it is preferred to transition this phase quickly.

During this time the piston K5 continues to be within its pumping stroke, as can also be seen in the diagram phase 2. But the slope of its motion is steeper now, this means its forward velocity is increased to a normal level (e. g. doubled), compared to the previous synchronous phase 1. Thereby, compared to phase 1 a continuous flow of thick material in the feed line is assured.

In Phase 3 the rotating slide 15 was turned by another 120° clockwise. It is located in its inlet position now; its intake section 15E lies in front of the opening of the feeding cylinder 3. At the same time the rotating slide 17 still is in its "transfer position", still allowing a feeding from the feeding cylinder 5 into the feed line.

The diagram shows in phase 3, that the piston K5 still runs at full speed, or with full pumping power, while the piston K3 performs an intake stroke, preferably with a soft start and finish, but overall with a higher speed than in the pump stroke ("intake phase"). Through the normal (weight-) pressure of the thick material in the prefilling container and its hydro dynamically advantageous guidance on the slide 15S, the feeding cylinder 3 is filled in an optimal manner.

Also in this phase a temporary stop of the oscillating motion of the rotating slide 15 can be advantageous so that the total intake stroke can be performed with feeding cylinder 3 completely open.

The position of the shift valve 9 in phase 4 of FIG. 4 corresponds to phase 2. The rotating slide 15 was turned back counter clockwise by 120°. Now, as can be seen from the diagram, the piston K3 (locked solid again by the blocking section 15B of the rotating slide 15) of the feeding cylinder 3, can pre compress the thick material through a very short stroke, preferably to the current operating pressure in the feed line ("pre compression phase"). This is also recommended with respect to gases taken in with the thick material (air bubbles) and with respect to the counter pressure from the collector tube 19 and the feed line, in order to avoid shocks in the system, when the cylinder opening in the following phase is connected again from the transfer section 15L to the feeding stream. Also here the rotating slide can be stopped temporarily or at least slowed down.

The piston K5 runs straight into the end phase of its pump stroke, still at full speed.

Phase 5 exactly corresponds to phase 1 with respect to the position of the shift valve 7 (starting position "synchronous phase"). The rotating valve 15 was tilted by another 120° counterclockwise. Also the diagram shows in phase 5, that now the pistons K3 and K5 with exchanged roles (relative to phase 1) recommence their phase shifted operation with simultaneous pumping at reduced speed. Now begins the motion cycle of the rotating slide 17.

Phase 6 is a mirror image of phase 2; now only the piston K3 pumps at full speed, while the blocking section 17B of the rotating slide 17, after tiling it by 120° clockwise tightly seals the feeding cylinder 5 and its piston K5 rests according to the diagram phase 6.

Phase 7 is a mirror image of phase 3. As mentioned before, also FIG. 2 shows this phase. The rotating slide 17 has been turned by another 120° clockwise. The feeding cylinder 5 is being refilled. Its piston K5 returns according to diagram phase 7 back into its starting position and via the intake section 17E the thick material flows into the feeding cylinder 5. At the same time the feeding cylinder 3 provides full pumping power, its piston K5 is at full forward velocity.

In phase 8, which is a mirror image of phase 4, the piston K5 pre compresses the newly filled in thick material, after turning the rotating slide 17 back by 120° counterclockwise, while the piston K3 reaches the end phase of its pumping stroke. In the diagram a full operating cycle of the two cylinder thick material pump is now completed, the further operation continues again with phase 1.

For emphasizing the velocities, pressures, and forces during the operation of the thick materials pump at continuous feed, it should be mentioned that the total course of the phases 1-8 occurs within only 6 seconds, as it is shown through the labeled time axis below the diagram. Thereby the pistons of the feeding cylinders have to go through strokes of approximately one meter length, while the total strokes of the rotating slides are in a range between 500 mm and 600 mm.

For further interpretation of the diagram of FIG. 5 it should initially be repeated, that in the phases 1 and 5 both pistons simultaneously pump thick material into the collector tube 19 and into the feed line. During these phases their velocities are adjusted relative to each other in a manner, so that their total feeding volume corresponds to the feeding volume of one single piston at normal forward velocity. Thereby, together with the pre compression phase of the newly starting piston, a practically shock free constant feed volume of the thick materials pump is accomplished.

In all other phases only one of the pistons is in pumping operation, and it then runs preferably at constant speed. The static pressure in the respective non moving branch of the collector tube 19 then corresponds to the pressure in the feed line. It is safely received by the sealing surfaces 15D or 17D of the rotating slide in its blocking and/or inlet position.

The design of the shift valve according to the invention and a dedicated forward motion control of the feeding pistons makes it possible to accomplish a constant output of the thick materials pump in the phases of the common pump strokes, compared to the single pumping power of a piston, and thereby practically eliminating the pulsation of the thick materials flow in the feed line. This is especially facilitated by the pre compression of the thick material in the phases 4 and 8, thereby avoiding the opening of a freshly filled feeding cylinder 3 or 5, or connecting a pressure free ("buffer space") with the feed line 13. The volume of the thick materials in the "reactivated" transfer section 15L or 17L is certainly negligibly small with respect to such buffer effect.

Though, through the pre compression steps (phases 4 and 8) considerable forces are imparted to the rotating slides 15 and 17, however they are easily received and transferred through their robust and still relatively simple pivoting bearing 27 within the guidance structure 11. Hereby also the advantage of a constant connection of the downstream end of the collector tube 19 with the feed line comes to bear.

The momentary positions of the pistons K3 and K5 and of the rotating slides 15 and 17 can be sensed with suitable sensors (distance sensors, position sensors, pressure sensors), possibly directly at the respective drives. The sensors 29 preferably provide their position signals to a preferably central control unit 31 of the thick materials pump, which in turn controls the drives of the feeding pistons K3 and K5 and drives 33 of the shift valve 9.

In particular, in moments of simultaneous feeding from both feeding cylinders it controls the reduction of their forward velocities. Not necessarily both pistons have to be controlled to half speed, but in principle one piston can be controlled to ⅓ of full velocity and the other one to ⅔ of full velocity (assuming equal diameters and total strokes). The goal remains a feeding stream, as constant as possible, of thick material in the feed line.

Furthermore the control unit 31 has to, during the time span, when the freshly filled feeding cylinder is locked by the blocking section of the associated rotating slide 15 or 17, on the one hand stop the shift valve or adjust it to slower travel, on the other hand control the pre compression stroke of the associated piston. This possibly requires an additional pressure sensor that can be located in the cylinder, in the piston, or also in the pressurized branch of the collector tube 19. A blocking of the rotating slides 15 and 17 through increased pressure during pre compression can certainly be excluded through a pressure limiter or similar.

Also in other phases, e.g. the synchronous phases, the transition phase and the inlet—or suction phase, a reduced speed of the rotating slides 15/17 or even their momentary stand still between the reversal points can be advantageous. Overall one will have to carefully weigh between stand still times and motion times of the rotating slides, so that on the one hand the available flow cross sections are not reduced too much through overlap of the blocking sections with the openings of the feeding cylinders, on the other hand no excessive slide velocities are required. With respect to a swift operation of the pump, however one will preferably try to keep standstill times of the rotating slides as small as possible or try to avoid them altogether.

In principle it is also possible to control a rotating operation instead of an oscillating operation with reversal phases of the rotating slides 15, 17 shown in FIG. 5. For the transition between the transfer position and the inlet position it is not mandatory to maintain a certain blocking position, since the inlet sections with the sealing plates 15D or 17D are also, (as mentioned previously) capable to receive the pressure from the feed line. From this the option results, to turn the rotating slides directly from the transfer position into the inlet position, instead of first going through the blocking position first.

FIGS. 6 and 7 each show variants of the embodiments of the rotating slides of the shift valve 9, which are basically also divided into sections with three different functions. Components with identical functions have the same reference numerals, as in FIGS. 1 through 5. While two rotating slides 15' and 17' with six sections each are shown, the rotating slides 15" and 17" of FIG. 7 each have four of them. Irrespective of that, these designs of the shift valves can basically be connected to the same thick materials pump, as the design discussed before. In both FIGS. 6 and 7 the feeding cylinders 3 and 5 are designated through their respective reference numerals in the area on both sides of the upper corner between the rotating slides.

The rotating slides 15' and 17' of FIG. 6 each have two intake sections 15E and 17E, two transfer sections 15L and 17L, two blocking sections 15B and 17B; for better recognition these are all not provided with reference numerals, since the associations directly result from the double identical presentation. Overall, therefore through the control of the shift valve 9 an angular division of 60° results, this means exactly half of the rotating slides 15 and 17 from the previous embodiment.

On the other hand the rotating slides 15" and 17" have an angular division of 90° between the single sections, wherein two blocking sections 15B and 17B are diametrically opposed to each other, enclosing a transfer section 15L/17L and an inlet section 15E/17E along the partial circle amongst each other. Overall this yields an angular division of 90° for the control of the shift valve 9.

With these shift valves 15' and 17' or 15" and 17" a rotating control and an oscillating control can be realized, in the latter case the time diagram of FIG. 5 with respective modifications can be adapted. In principle the operation of the thick materials pump, supplied with it does not change relative to the embodiment with only three functional sections, however through the increase in the number of sections, shorter shifting distances and a further improved continuous feeding operation of the thick materials pump can be achieved.

The quadruple divided rotating slides 15" and 17" allow a continuous rotating operation with their double blocking sections. It can be seen that when continuing to rotate by 90°, always one of the paired blocking sections 15B/17B follow upon the transfer section 15L/17L or the intake section 15E/17E.

The invention claimed is:

1. A multi cylinder thick materials pump for providing concrete comprising:

at least two stationary feeding cylinders for feeding a thick material from a pre filling container into a feed line; and a shift valve associated with the feed line for alternatively connecting the feeding cylinders with the feed line, the shift valve comprising:

at least two moveable valve bodies, each of the valve bodies including a straight transfer section between a respective one of the feeding cylinders and the feed line, the shift valve being connected downstream of the feeding cylinders to a collector tube; and each of the moveable valve bodies comprising a rotationally movable rotating slide having an axis of rotation that is offset from the axis of its respective feeding cylinder, each of the rotating slides including at least three sections disposed about the axis of rotation of the rotating slide that are selectively rotated into alignment with its respective feeding cylinder comprising the straight transfer sections formed as an aperture passing through the rotating slide for connecting the respective one of the feeding cylinders with the feed line, a blocking section for blocking the connection between the respective feeding cylinder and the feed line, and an inlet section which when rotated into alignment with its respective feeding cylinder is simultaneously aligned with the pre filling container;

wherein the rotation of each rotating slide and the operation of each feeding cylinder is coordinated to provide a substantially continuous flow of concrete through the feed line.

2. A thick materials pump according to claim 1, wherein the shift valve comprises a guidance structure for the rotating slides, the guidance structure having openings for passing through thick materials flows.

3. A thick materials pump according to claim 2, wherein each rotating slide has an inlet opening, the guidance structure being mounted to the prefilling container in a fixed manner so that the rotating slides and their inlet openings are always in contact with the thick material filled in.

4. A thick materials pump according to claim 2, wherein the guidance structure is substantially shaped as a box or as a frame, the box or frame including a bearing for each rotating slide.

5. A thick materials pump according to claim 2, wherein each rotating slide can be positioned within the guidance structure through pivoting around its respective axis of rotation into at least two different positions, one of the positions being a transfer position wherein the feeding cylinder can eject into the collector tube and the other position being a blocking- or inlet position wherein the feeding cylinder can suck thick material out of the pre filling container.

6. A thick materials pump according to claim 1, wherein the rotating slides are substantially identical or mirror images of each other.

7. A thick materials pump according to claim 2, wherein the rotating slides are drum shaped and are held in the guidance structure on both sides so they can rotate.

8. A thick materials pump according to claim 1, wherein each inlet section comprises an open inlet being radially oriented relative to the axis of rotation of the rotating slide and an exhaust parallel to said axis of rotation facing towards the feeding cylinder.

9. A thick materials pump according to claim 8, further comprising a deflection device in the inlet section of at least one rotating slide.

10. A thick materials pump according to claim 1, wherein each blocking section without through flow function is located between the transfer section and the inlet section of a respective slide.

11. A thick materials pump according to claim 1, wherein the three sections of each rotating slide are located on a joint partial circle with distances evenly spaced relative to each other.

12. A thick materials pump according to claim 1, wherein the three sections of the rotating slides are provided as single modules and connected to each other so they can be disconnected.

13. A thick materials pump according to claim 1, wherein each rotating slide is divided into six sections, two of the sections of the rotating slides being transfer sections, two other sections of the rotating slides being inlet sections, and another two of the sections of the rotating slides being blocking sections.

14. A thick materials pump according to claim 1, wherein each rotating slide is divided into four sections, one of the four sections being the transfer section, another of the four sections being the inlet section, and another two of the four sections being blocking sections.

15. A thick materials pump according to claim 1, further comprising at least one flap for removing thick material from the transfer section of at least one rotating slide.

16. A thick materials pump according to claim 1, wherein the rotating slides are independently drivable and positionable.

17. A thick materials pump according to claim 16, further comprising a drive for each rotating slide, each drive driving the rotation axis of a respective rotating slide.

18. A thick materials pump according to claim 1, wherein the transfer section of each rotating slide comprises a cylindrical tube with the same diameter as the feeding cylinders.

19. A thick materials pump according to claim 1, further comprising a control unit and position indicators, wherein momentary positions of the shift valve and the rotating slides as well as of feeding pistons of the feeding cylinders are provided to the control unit, and the control unit controls the driving of the rotating slides and of the feeding pistons according to a predetermined time distance pattern in a cyclical manner.

20. A thick materials pump according to claim 1, wherein each feeding cylinder is operated to perform a pre compression operation when the blocking section of the respective rotating slide is aligned with the feeding cylinder.

21. A thick materials pump according to claim 1, wherein the cross sectional area of the straight transfer section of each rotating slide is substantially equal to the cross sectional area of its respective feeding cylinder.

22. A thick materials pump according to claim 1, wherein the axis of rotation of each said rotating slide is generally parallel with the axis of its respective feeding cylinder.

23. A process for operating a thick materials pump for continuous feeding comprising:

providing the thick materials pump comprising at least two stationary open feeding cylinders with feeding pistons and a shift valve with independently controllable rotating slides, each rotating slide being associated with a respective feeding cylinder and having an axis of rotation that is offset from the axis of its respective feeding cylinder and including at least one transfer section for connecting an associated feeding cylinder with a feed line and an intake section for sucking in thick material from a pre filling container through the associated feeding cylinder, wherein the transfer section and intake section of each rotating slide are selectively rotated into alignment with its respective feeding cylinder and wherein the feeding pistons have a synchronous travel phase; and controlling the pistons in a cyclic manner such that when the two rotating slides are located in a transfer position, their transfer sections connect the associated feeding cylinders to the feed line for preliminary simultaneous expulsion of thick material.

24. A process according to claim 23, wherein the controlling includes controlling the feeding pistons in a manner in the synchronous travel phase whereby they are adjusted to each other, so that the thick materials quantity pumped by them simultaneously is approximately equal to feeding through one piston alone, during a suction stroke of the respective other piston.

25. A process according to claim 24, further momentarily closing an opening of each feed cylinder at the beginning of a pump stroke of each feeding piston through a blocking section of the rotating slides.

26. A process according to claim 25, wherein each pump stroke of each piston comprises at least a pre compression phase, a first synchronous travel phase, a pump phase, and a second synchronous travel phase.

27. A process according to claim 23, further comprising driving the feeding pistons at the same speed during the synchronous phase.

28. A process according to claims 23, wherein upon a pump stroke a transition phase with a stand still of the feeding piston during a continuing pump stroke of the other feeding piston follows.

29. A process according to claim 23, further comprising operating a suction stroke of each piston faster than a pump stroke of that piston.

30. A process according to claim 29, further comprising operating the suction stroke of at least one of the pistons with a start ramp and a stop ramp with reduced speed.

31. A process according to claim 23, further comprising slowing down or stopping momentarily the rotating slides during the synchronous travel phase.

32. A process according to claim 23, further comprising slowing down or stopping momentarily the rotating slides during a pre compression phase.

33. A process according to claim 23, further comprising slowing down or stopping momentarily the rotating slides during a transition phase.

34. A process according to claim 23, further comprising slowing down or stopping momentarily the rotating slides during a suction phase.

35. A process according to claim 23, further comprising positioning the rotating slides in an operating position in an operational pause of the thick materials pump, and allowing the removal of remaining thick material and the insertion of a cleaning body when required.

36. A process according claim 35, further comprising providing the operating position with an inlet position of the rotating slide.

37. A process according to claim 35, further comprising providing a safety device for preventing the starting of the rotating slide, said safety device being activated during the removal and/or insertion process.

* * * * *

UNITED STATES PATENT AND TRADEMARK OFFICE

CERTIFICATE OF CORRECTION

PATENT NO. : 8,123,504 B2
APPLICATION NO. : 10/590795
DATED : February 28, 2012
INVENTOR(S) : Manfred Lenhart It is certified that error appears in the above-identified patent and that said Letters Patent is hereby corrected as shown below:

Column 13

Line 26, Claim 1, "transfer sections" should be --transfer section--

Signed and Sealed this
Twelfth Day of March, 2013

Teresa Stanek Rea
*Acting Director of the United States Patent and Trademark Office*